US009404330B2

(12) United States Patent
Speer et al.

(10) Patent No.: US 9,404,330 B2
(45) Date of Patent: Aug. 2, 2016

(54) METHOD AND APPARATUS FOR A WELL EMPLOYING THE USE OF AN ACTIVATION BALL

(71) Applicant: SCHLUMBERGER TECHNOLOGY CORPORATION, Sugar Land, TX (US)

(72) Inventors: Tracy Speer, Tyler, TX (US); Piro Shkurti, The Woodlands, TX (US); John Chrysostom Wolf, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/193,822

(22) Filed: Feb. 28, 2014

(65) Prior Publication Data

US 2014/0174728 A1 Jun. 26, 2014

Related U.S. Application Data

(63) Continuation of application No. 13/180,029, filed on Jul. 11, 2011.

(60) Provisional application No. 61/364,267, filed on Jul. 14, 2010, provisional application No. 61/363,547, filed on Jul. 12, 2010.

(51) Int. Cl.

| | |
|---|---|
| ***E21B 34/14*** | (2006.01) |
| ***E21B 47/06*** | (2012.01) |
| ***E21B 47/13*** | (2012.01) |
| ***E21B 23/04*** | (2006.01) |

(52) U.S. Cl.

CPC ..... *E21B 23/04* (2013.01)

(58) Field of Classification Search

CPC ..... E21B 47/065; E21B 47/06; E21B 47/124; E21B 47/12; E21B 34/14

USPC ..... 166/318, 66

See application file for complete search history.

(56) References Cited

U.S. PATENT DOCUMENTS

| | | | |
|---|---|---|---|
| 2,155,129 | A | 4/1939 | Hall et al. |
| 2,165,433 | A | 7/1939 | Wickersham |
| 2,177,928 | A | 10/1939 | Knudsen |
| 2,215,913 | A | 9/1940 | Brown |
| 2,754,910 | A | 7/1956 | Derrick et al. |
| 3,100,350 | A | 8/1963 | Brown |

(Continued)

FOREIGN PATENT DOCUMENTS

| | | | |
|---|---|---|---|
| AU | 2009242942 | A1 | 11/2009 |
| CN | 2324536 | Y | 6/1999 |

(Continued)

OTHER PUBLICATIONS

International Search Report and Written Opinion issued in PCT/2011/043630 on Feb. 23, 2012; 10 pages.

*Primary Examiner* — Kenneth L Thompson

(74) *Attorney, Agent, or Firm* — Jeffery R. Peterson

(57) ABSTRACT

A system includes a tubular string and a hollow ball. The tubular string is adapted to be deployed downhole in a well and includes a seat. An activation ball adapted to be deployed in the well to lodge in the seat. The ball includes an outer shell that forms a spherical surface. The outer shell forms an enclosed volume therein, and the outer shell is formed from a metallic material.

22 Claims, 7 Drawing Sheets

(56) References Cited

U.S. PATENT DOCUMENTS

| | | | | |
|---|---|---|---|---|
| 3,195,660 | A | 7/1965 | McKown | |
| 3,299,193 | A | 1/1967 | Maria | |
| 3,410,217 | A * | 11/1968 | Kelley | E21B 43/38 417/295 |
| 3,599,307 | A | 8/1971 | Campbell et al. | |
| 3,620,228 | A | 11/1971 | Schmid | |
| 3,772,750 | A | 11/1973 | Hauser | |
| 5,146,992 | A | 9/1992 | Baugh | |
| 5,485,882 | A | 1/1996 | Bailey et al. | |
| 5,511,620 | A | 4/1996 | Baugh et al. | |
| 5,701,959 | A | 12/1997 | Hushbeck et al. | |
| 5,739,440 | A * | 4/1998 | Diadelfo | G01N 1/12 210/538 |
| 5,941,309 | A | 8/1999 | Appleton | |
| 6,170,573 | B1 * | 1/2001 | Brunet et al. | 166/153 |
| 6,241,028 | B1 * | 6/2001 | Bijleveld et al. | 175/40 |
| 6,318,470 | B1 | 11/2001 | Chang et al. | |
| 6,324,904 | B1 * | 12/2001 | Ishikawa et al. | 73/152.03 |
| 6,491,108 | B1 | 12/2002 | Slup et al. | |
| 6,543,365 | B1 | 4/2003 | Vasel et al. | |
| 6,578,633 | B2 | 6/2003 | Slup et al. | |
| 6,695,050 | B2 | 2/2004 | Winslow et al. | |
| 6,708,768 | B2 | 3/2004 | Slup et al. | |
| 6,708,770 | B2 | 3/2004 | Slup et al. | |
| 6,745,833 | B2 * | 6/2004 | Aronstam et al. | 166/250.11 |
| 6,802,373 | B2 * | 10/2004 | Dillenbeck et al. | 166/255.1 |
| 6,935,425 | B2 * | 8/2005 | Aronstam | 166/250.11 |
| 7,021,389 | B2 | 4/2006 | Bishop et al. | |
| 7,051,816 | B2 * | 5/2006 | Khomynets | 166/372 |
| 7,255,178 | B2 | 8/2007 | Slup et al. | |
| 7,309,446 | B1 | 12/2007 | Kley | |
| 7,387,165 | B2 | 6/2008 | Lopez de Cardenas et al. | |
| 7,455,108 | B2 * | 11/2008 | Jenkins et al. | 166/250.11 |
| 7,523,666 | B2 * | 4/2009 | Thompson et al. | 73/592 |
| 7,600,572 | B2 | 10/2009 | Slup et al. | |
| 7,628,210 | B2 | 12/2009 | Avant et al. | |
| 7,810,558 | B2 | 10/2010 | Shkurti et al. | |
| 7,841,249 | B2 * | 11/2010 | Tormoen | 73/866.5 |
| 7,980,300 | B2 | 7/2011 | Roberts et al. | |
| 8,145,420 | B2 | 3/2012 | Chappell et al. | |
| 8,317,080 | B2 * | 11/2012 | Kingston | B23K 20/122 228/112.1 |
| 8,318,080 | B2 | 11/2012 | Ueoka et al. | |
| 8,584,519 | B2 * | 11/2013 | Maida et al. | 73/152.54 |
| 8,851,172 | B1 * | 10/2014 | Dudzinski | E21B 33/138 166/193 |
| 2007/0007007 | A1 | 1/2007 | Themig et al. | |
| 2007/0107908 | A1 | 5/2007 | Vaidya et al. | |
| 2007/0261855 | A1 | 11/2007 | Brunet et al. | |
| 2007/0272411 | A1 | 11/2007 | Lopez De Cardenas et al. | |
| 2008/0204008 | A1 * | 8/2008 | Paulson | 324/220 |
| 2009/0308588 | A1 * | 12/2009 | Howell et al. | 166/66.4 |
| 2010/0084146 | A1 | 4/2010 | Roberts | |
| 2010/0252256 | A1 | 10/2010 | Plooy et al. | |
| 2010/0314126 | A1 | 12/2010 | Kellner | |
| 2011/0030947 | A1 * | 2/2011 | Schreiber et al. | 166/250.01 |
| 2011/0056692 | A1 | 3/2011 | Lopez de Cardenas et al. | |
| 2011/0132620 | A1 | 6/2011 | Agrawal et al. | |
| 2011/0253373 | A1 * | 10/2011 | Kumar et al. | 166/306 |
| 2012/0006561 | A1 | 1/2012 | Johnson et al. | |
| 2012/0085538 | A1 | 4/2012 | Guerrero et al. | |
| 2012/0118583 | A1 | 5/2012 | Johnson et al. | |
| 2012/0168163 | A1 | 7/2012 | Bertoja et al. | |
| 2012/0305313 | A1 * | 12/2012 | DiFoggio | 175/45 |
| 2013/0000926 | A1 | 1/2013 | Parrott et al. | |
| 2013/0062063 | A1 | 3/2013 | Baihly et al. | |
| 2013/0068461 | A1 * | 3/2013 | Maerz | E21B 33/10 166/297 |
| 2013/0081827 | A1 | 4/2013 | Etzel | |
| 2013/0112435 | A1 | 5/2013 | Fleming et al. | |
| 2013/0112436 | A1 | 5/2013 | Fleming et al. | |
| 2013/0140030 | A1 | 6/2013 | Rankin | |
| 2013/0175033 | A1 | 7/2013 | Baihly et al. | |
| 2013/0175052 | A1 | 7/2013 | Baihly | |
| 2013/0192823 | A1 * | 8/2013 | Barrilleaux et al. | 166/250.01 |
| 2014/0034310 | A1 * | 2/2014 | Andersen | 166/281 |
| 2014/0083689 | A1 * | 3/2014 | Streich et al. | 166/250.15 |

FOREIGN PATENT DOCUMENTS

| | | | |
|---|---|---|---|
| CN | 2390048 | Y | 8/2000 |
| CN | 2486062 | Y | 4/2002 |
| CN | 201220700 | Y | 4/2009 |
| RU | 1809009 | A1 | 4/1993 |
| RU | 18839 | U1 | 7/2001 |
| WO | 2006134446 | A2 | 12/2006 |

* cited by examiner

METHOD AND APPARATUS FOR A WELL EMPLOYING THE USE OF AN ACTIVATION BALL

This application is a continuation application of co-pending U.S. patent application Ser. No. 13/180,029, entitled "METHOD AND APPARATUS FOR A WELL EMPLOYING THE USE OF AN ACTIVATION BALL," which was filed on Jul. 11, 2011. This application also claims priority from U.S. Provisional Patent Application Ser. No. 61/364,267 entitled, "HOLLOW METALLIC ACTIVATION BALL," which was filed on Jul. 14, 2010, and U.S. Provisional Patent Application Ser. No. 61/363,547 entitled, "ALLOY METALLIC ACTIVATION BALL," which was filed on Jul. 12, 2010. Each of these applications are hereby incorporated by reference in their entireties.

TECHNICAL FIELD

The invention generally relates to a method and apparatus for a well employing the use of an activation ball.

BACKGROUND

For purposes of preparing a well for the production of oil and gas, at least one perforating gun may be deployed into the well via a deployment mechanism, such as a wireline or a coiled tubing string. Shaped charges of the perforating gun(s) may then be fired when the gun(s) are appropriately positioned to form perforating tunnels into the surrounding formation and possibly perforate a casing of the well, if the well is cased. Additional operations may be performed in the well to increase the well's permeability, such as well stimulation operations and operations that involve hydraulic fracturing, acidizing, etc. During these operations, various downhole tools may be used, which require activation and/or deactivation. As non-limiting examples, these tools may include fracturing valves, expandable underreamers and liner hangers.

SUMMARY

In an embodiment, a system includes a tubular string and an activation ball. The tubular string is adapted to be deployed in the well, and the activation ball is adapted to be deployed in the tubular string to lodge in the seat. The activation ball includes an outer shell that forms a spherical surface. The outer shell forms an enclosed volume therein, and the outer shell is formed from a metallic material.

In another embodiment, a technique includes deploying an activation ball in a downhole tubular string in a well. The activation ball includes an outer shell that has an enclosed volume therein. The outer shell includes a metallic material. The technique includes communicating the ball through a passageway of the tubular string until the ball lodges in a seat of the string to form an obstruction (or fluid tight barrier), and the method includes using the obstruction to pressurize a region of the string.

Other features and advantages will become apparent from the following description and the appended claims.

DETAILED DESCRIPTION

Figure 1:
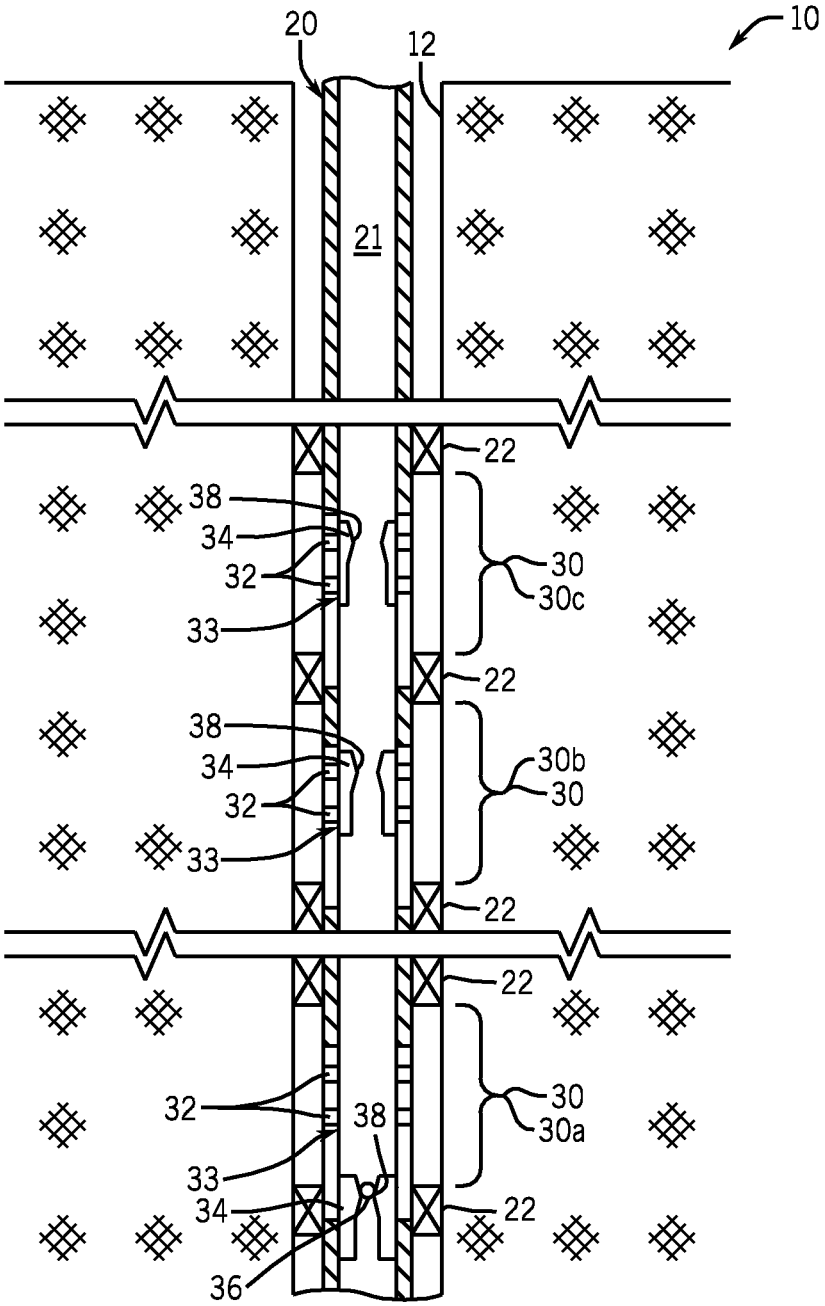
FIG. 1 is a schematic diagram of a well according to an embodiment of the invention.

Systems and techniques are disclosed herein for purposes of using a light weight activation ball to activate a downhole tool. Such an activation ball may be used in a well 10 that is depicted in FIG. 1. For this example, the well 10 includes a wellbore 12 that extends through one or more reservoir formations. Although depicted in FIG. 1 as being a main vertical wellbore, the wellbore 12 may be a deviated or horizontal wellbore, in accordance with other embodiments of the invention.

As depicted in FIG. 1, a tubular string 20 (a casing string, as a non-limiting example) extends into the wellbore 12 and includes packers 22, which are radially expanded, or "set," for purposes of forming corresponding annular seal(s) between the outer surface of the tubular string 20 and the wellbore wall. The packers 22, when set form corresponding isolated zones 30 (zones 30*a*, 30*b* and 30*c* being depicted in FIG. 1, as non-limiting examples), in which may be performed various completion operations. In this manner, after the tubular string 20 is run into the wellbore 12 and the packers 22 are set, completion operations may be performed in one zone 30 at a time for purposes of performing such completion operations as fracturing, stimulation, acidizing, etc., depending on the particular implementation.

For purposes of selecting a given zone 30 for a completion operation, the tubular string 20 includes tools that are selectively operated using light weight activation balls 36. As described herein, each activation ball 36 is constructed from an outer metallic shell and may be hollow, in accordance with some implementations.

Figure 3C:
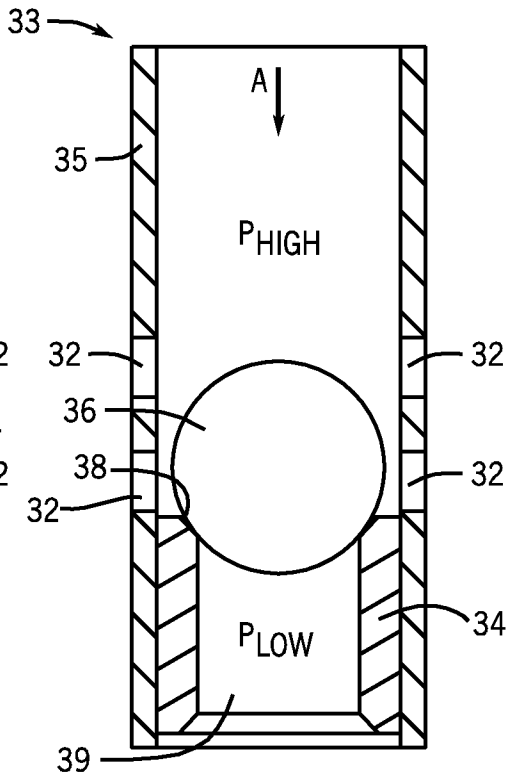
FIGS. 3A, 3B and 3C are cross-sectional views of an exemplary ball-activated tool of FIG. 1 according to an embodiment of the invention.

For the particular non-limiting example that is depicted in FIG. 1, the downhole tools are sleeve valves 33. In general, for this example, each sleeve valve 33 is associated with a given zone 30 and includes a sleeve 34 that is operated via a deployed activation ball 36 to selectively open the sleeve 34. In this regard, in accordance with some embodiments of the invention, the sleeve valves 33 are all initially configured to be closed when installed in the well as part of the string 20. Referring to FIG. 3A in conjunction with FIG. 1, when closed (as depicted in zones 30*b* and 30*c*), the sleeve 34 covers radial ports 32 (formed in a housing 35 of the sleeve valve 33, which is concentric with the tubular string 30) to block fluid communication between a central passageway 21 of the tubular string 20 and the annulus of the associated zone 30. Although not shown in these figures, the sleeve valve 33 has associated seals (o-rings, for example) for purposes of sealing off fluid communication through the radial ports 32.

The sleeve valve 33 may be opened by deployment of a given activation ball 36, as depicted in zone 30*a* of FIG. 1.

Figure 3B:
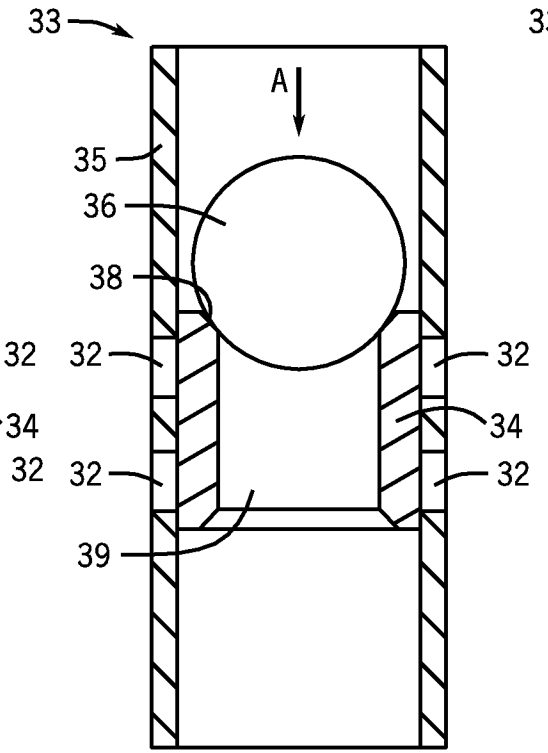
Figure 3A:
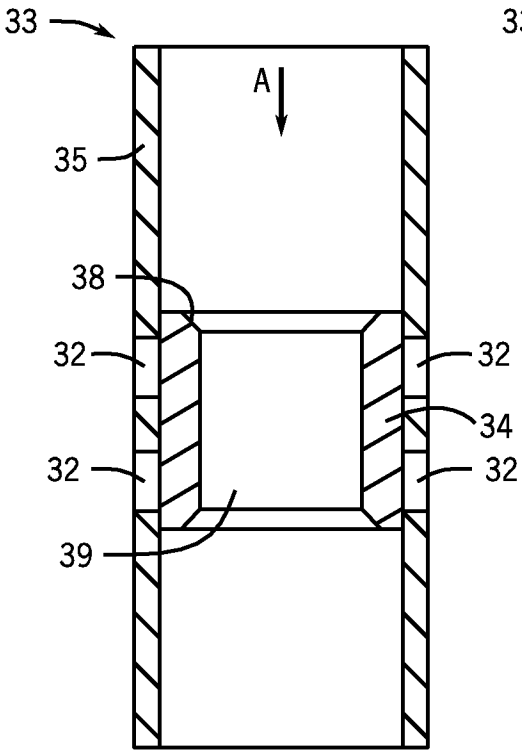

Referring to FIG. 3B in conjunction with FIG. 1, in this regard, the activation ball 36 is deployed from the surface of the well and travels downhole (in the direction of arrow "A") through the central passageway 21 to eventually lodge in a seat 38 of the sleeve 34. Referring to FIG. 3C in conjunction with FIG. 1, when lodged in the seat 38, an obstruction (or fluid tight barrier) is created, which allows fluid pressure to be increased (by operating fluid pumps at the surface of the well, for example) to exert a downward force on the sleeve 34 due to the pressure differential (i.e., a high pressure "$P_{high}$" above the ball 36 and a low pressure "$P_{low}$" below the ball 36) to cause the sleeve valve 33 to open and thereby allow fluid communication through the associated radial ports 32.

Referring to FIG. 1, in accordance with an exemplary, non-limiting embodiment, the seats 38 of the sleeve valves 33 are graduated such that the inner diameters of the seats 38 become progressively smaller from the surface of the well toward the end, or toe, of the wellbore 12. Due to the graduated openings, a series of varying diameter hollow activation balls 36 may be used to select and activate a given sleeve valve. In this manner, for the exemplary arrangement described herein, the smallest outer diameter activation ball 36 is first deployed into the central passageway 21 of the tubular string 20 for purposes of activating the lowest sleeve valve. For the example depicted in FIG. 1, the activation ball 36 that is used to activate the sleeve valve 33 for the zone 30*a* is thereby smaller than the corresponding hollow activation ball 36 (not shown) that is used to activate the sleeve valve 33 for the zone 30*b*. In a corresponding manner, an activation ball 36 (not shown) that is of a yet larger outer diameter may be used activate the sleeve valve 33 for the zone 30*c*, and so forth.

Although FIG. 1 depicts a system of varying, fixed diameter seats 38, other systems may be used in accordance with other embodiments of the invention. For example, in accordance with other embodiments of the invention, a tubular string may contain valve seats that are selectively placed in "object catching states" by hydraulic control lines, for example. Regardless of the particular system used, a tubular string includes at least one downhole tool that is activated by an activation ball, which is deployed through a passageway of the string. Thus, other variations are contemplated and are within the scope of the appended claims.

Removing a given activation ball 36 from its seat 38 may be used to relieve the pressure differential resulting from the obstruction of the passageway 37 (see FIG. 3C) through the sleeve valve 33. A seated actuation ball 36 may be removed from the seat 38 in a number of different ways. As non-limiting examples, the activation ball 36 may be made of a drillable material so that activation ball 36 may be milled to allow fluid flow through the central passageway 21. Alternatively, the valve seat 38, the sleeve 34 or the activation ball 36 may be constructed from a deformable material, such that the activation ball 36 may be extruded through the seat 38 at a higher pressure, thereby opening the central passageway 21. As yet another example, the flow of fluid through the central passageway 21 may be reversed so that the activation ball 36 may be pushed upwardly through the central passageway 21 toward the surface of the well. In this manner, a reverse circulation flow may be established between the central passageway 21 and the annulus to retrieve the ball 36 to the surface of the well. By reversing fluid flow to dislodge the activation ball 36, the activation ball 36 is non-destructably removed from the well so that both the activation ball 36 and the corresponding sleeve valve may be reused.

When the activation ball 36 is retrieved by flowing fluid upwardly through the central passageway 21, the activation ball 36 may have a particular specific gravity so that upwardly flowing fluid can remove the activation ball 36 from the seat 38. While the specific gravity of the activation ball 36 may be a relatively important constraint, the activation ball 36 should be able to withstand the impact of seating in the seat 38, the building of a pressure differential across the ball 36 and the higher temperatures present in the downhole environment. The failure of the activation ball 36 to maintain its shape and structure during use may lead to failure of the downhole tool, such as the sleeve valve. For example, deformation of the activation ball 36 under impact loads, high pressure for high temperatures may conceivably prevent the activation ball 36 from properly sealing against the seat 38, thereby preventing the effective buildup of a pressure differential. In other scenarios, the deformation of the activation ball 36 may cause the activation ball 36 to slide through the seat 38 and to become lodged in the sleeve 34, such that it may be relatively challenging to remove the activation ball 36.

In embodiments where activation ball 36 is designed to be retrieved by flowing fluid upwardly through the central passageway 21, the activation ball 36 may have the following specific physical properties. Specifically, the activation ball 36 may have a particular specific gravity so that the upward flowing fluid can remove the activation ball 36 from the seat 38 and carry it upward through central passageway 21. While the specific gravity of the activation ball 36 may be a relatively important constraint, the activation ball 36 may also be able to withstand the impact of seating in the downhole tool, the building of a pressure differential across the activation ball 36, and the high temperatures of a downhole environment. Failure of the activation ball 36 to maintain its shape and structure during use may lead to failure of the downhole tool. For example, deformation of the activation ball 36 under impact loads, high pressures, or high temperatures may prevent activation ball 36 from properly sealing against seat 38, thereby preventing the effective build up of a pressure differential. In other scenarios, deformation of the activation ball 36 may cause the activation ball 36 to slide through the seat 38 and to become lodged in the sleeve 34, such that conventional means of removing activation ball 112 may be ineffective.

As disclosed herein, traditional activation balls may be solid spheres, which are constructed from plastics, such as for example, polyetheretherketone, or fiber-reinforced plastics, such as, for example, fiber-reinforced phenolic. While a traditional activation ball may meet specific gravity requirements, inconsistency in material properties between batches may present challenges such that the activation balls may be overdesigned so that their strength ratings, pressure ratings and temperature ratings are conservative. In accordance with embodiments of the disclosed herein, the activation ball 36 is constructed out of a metallic shell and as such, may be a hollow ball or sphere, which permits the activation ball 36 to have desired strength properties while being light enough to allow removal of the ball 36 from the well.

Figure 2:
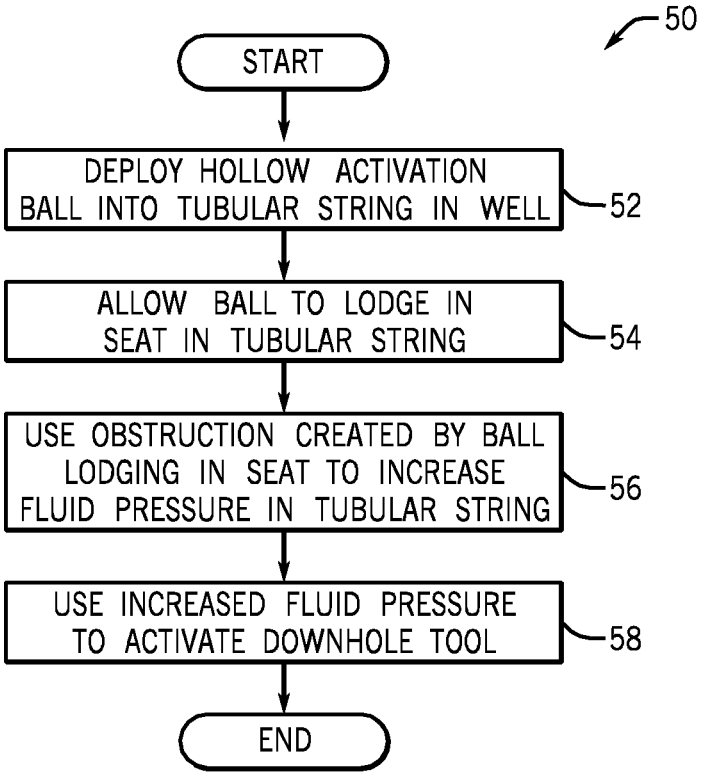
FIG. 2 is a flow diagram depicting a technique using an activation ball in a well according to an embodiment of the invention.

Referring to FIG. 2, thus, in accordance with some embodiments of the invention, a technique 50 includes deploying (block 52) a shell-based activation ball, such as a hollow activation ball, into a tubular string in a well and allowing (block 54) the ball to lodge in a seat of the string. The technique 50 includes using (block 56) an obstruction created by the activation ball lodging in the seat to increase fluid pressure in the tubular string and using (block 58) the increased fluid pressure to activate a downhole tool.

Figure 4:
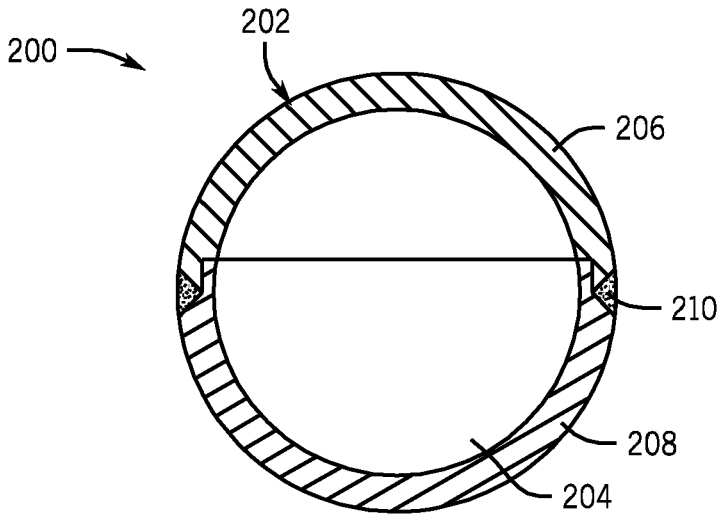
FIG. 4 is a cross-sectional view of an activation ball in accordance with embodiments disclosed herein.

Referring to FIG. 4, a cross-sectional view of a hollow activation ball 200 in accordance with embodiments disclosed herein is shown. Hollow activation ball 200 includes an outer shell 202 having an enclosed hollow volume 204.

Outer shell 202 may be formed from a first portion 206 and a second portion 208 which may be joined together using joining methods such as, for example, welding, friction stir welding, threading, adhering, pressure fitting, and/or mechanical fastening. As shown in FIG. 4, first and second portions 206, 208 of outer shell 202 are joined using a weld 210; however, those of ordinary skill in the art will appreciate that any known method of joining two parts may be used.

In certain embodiments, outer shell 202 may be formed from a metallic material. The metallic material may include a metallic alloy such as, for example, aluminum alloy and/or magnesium alloy. Aluminum alloys from the 6000 series and 7000 series may be used such as, for example, 6061 aluminum alloy or 7075 aluminum alloy. Although the specific gravity of most metallic materials is greater than 2.0, a hollow activation ball 200 in accordance with the present disclosure may have a specific gravity less than 2.0. Preferably, the specific gravity of hollow activation ball 200 in accordance with embodiments disclosed herein is between about 1.00 and about 1.85.

Figure 5:
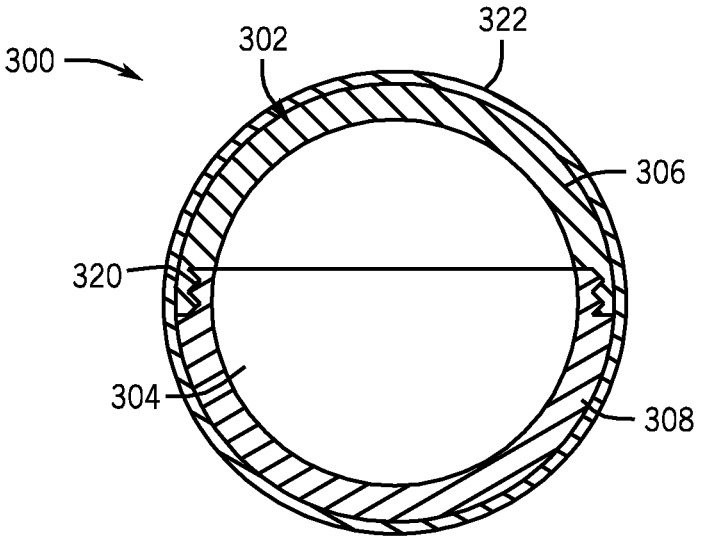
FIG. 5 is a cross-sectional view of an activation ball in accordance with embodiments disclosed herein.

Referring to FIG. 5, a cross-section view of an activation ball 300 in accordance with embodiments disclosed herein is shown. Similar to hollow activation ball 200 (FIG. 4), hollow activation ball 300 includes an outer shell 302 having an enclosed volume 304. Outer shell 302 may be formed from a first portion 306 and a second portion 308, joined together using threads 320. One of ordinary skill in the art will appreciate that other joining or coupling methods may be used such as, for example, welding. Hollow activation ball 300 may further include a coating 322 disposed over an outer surface of outer shell 302. Coating 322 may be a corrosion resistant material such as, for example, polytetrafluoroethylene, perfluoroalkoxy copolymer resin, fluorinated ethylene propylene resin, ethylene tetrafluoroethylene, polyvinylidene fluoride, ceramic material, and/or an epoxy-based coating material. In certain embodiments, coating 322 may include Fluorolon® 610-E, available from Southwest Impreglon of Houston, Tex.

Coating 322 may be between 0.001 and 0.005 inches thick, and may be applied by dipping outer shell 302 in the coating material, by spraying the coating material onto outer shell 302, by rolling outer shell 302 through the coating material, or by any other known coating application method. In certain embodiments, coating 322 may include a plating, an anodized layer, and/or a laser cladding. The coating material and the thickness of coating 322 may be selected such that activation ball 300 has an overall specific gravity between about 1.00 and about 1.85. Additionally, the coating material may be chosen to provide activation ball 300 with improved properties such as, for example, improved corrosion resistance and/or improved abrasion resistance. Specifically, the coating material may be selected to prevent a reaction between the metallic material of outer shell 302 and downhole fluids such as drilling mud or produced fluid.

Figure 6:
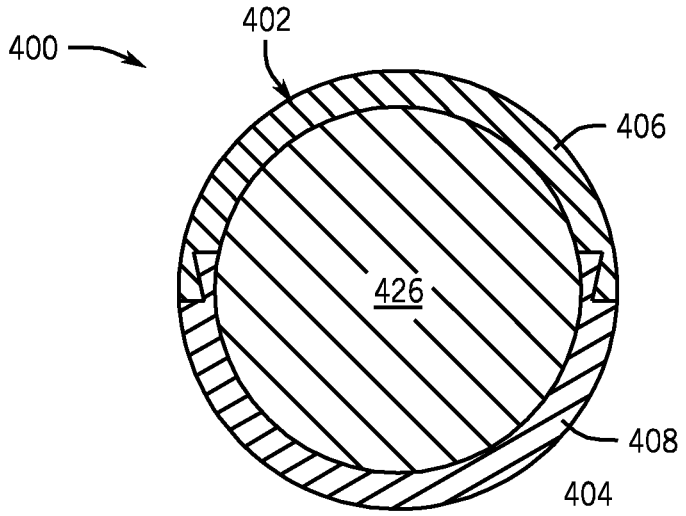
FIG. 6 is a cross-sectional view of an activation ball in accordance with embodiments disclosed herein.

Referring to FIG. 6, a cross-section view of an activation ball in accordance with embodiments disclosed herein is shown. Hollow activation ball 400 includes an outer shell 402 having an enclosed volume 404. Outer shell 402 may include a first portion 406 and a second portion 408 joined using an interference fit 424; however, other joining methods such as welding, adhering, and threading may be used. Enclosed volume 404 may include a fill material 426 to provide additional support to shell 402 under high impact loads, pressures, and temperatures. In certain embodiments, fill material 426 may include at least one of a plastic, a thermoplastic, a foam, and a fiber reinforced phenolic. Fill material 426 may be selected such that the overall specific gravity of activation ball 400 is between about 1.00 and about 1.85. Although activation ball 400 is not shown including a coating, a coating may be added similar to coating 322 shown on activation ball 300 (FIG. 5).

In other embodiments, hollow volume 404 may be filled with a gas such as, for example, nitrogen. The gas may be pressurized to provide support within outer shell 402 which may allow activation ball 400 to maintain its spherical shape under high impact loads, pressures, and temperatures. Hollow volume 404 may be filled with gas using an opening or port (not shown) disposed in outer shell 402. After a desired amount of gas is pumped into hollow volume 404 and a desired internal pressure is reached, the port (not shown) may be sealed or capped to prevent gas from leaking out of activation ball 400.

Figure 7A:
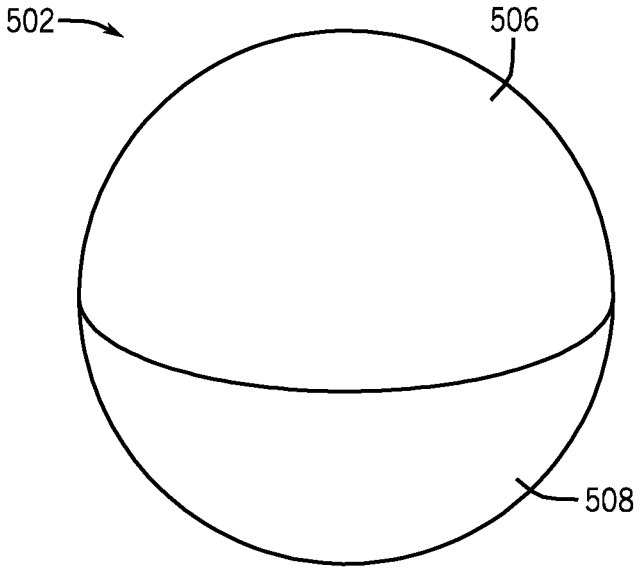
FIG. 7A is a perspective view of an activation ball in accordance with embodiments disclosed herein.
Figure 7B:
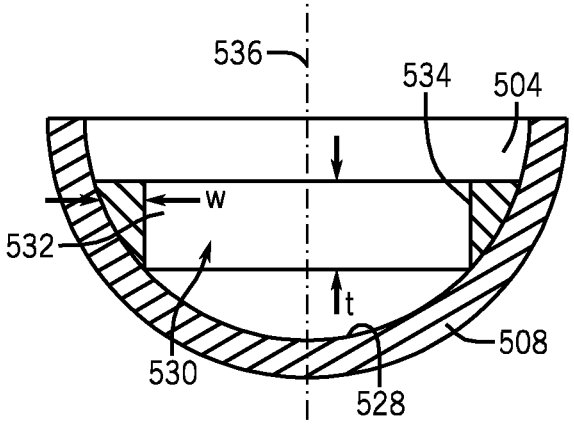
FIGS. 7B-7D are cross-sectional views of a portion of an activation ball in accordance with embodiments disclosed herein.

Referring to FIG. 7A, a perspective view of a joined outer shell 502 including a first portion 506 and a second portion 508 in accordance with embodiments disclosed herein is shown. Referring now to FIG. 7B, a side cross-sectional view of second portion 508 of outer shell 502 is shown. Only second portion 508 of outer shell 502 is shown for simplicity, and those of ordinary skill in the art will appreciate that the corresponding first portion 506 may be substantially the same as second portion 508.

Outer shell 502 includes a hollow volume 504, an inner surface 528, and a support structure 530 disposed on the inner surface 528. Support structure 530 may include a reinforcing ring 532 as shown which may be coupled to inner surface 528 of second portion 508 of outer shell 502. Although only one reinforcing ring 532 is shown, those of ordinary skill in the art will appreciate that multiple reinforcing rings may be used having any desired thickness, t, and any desired maximum width, w. Additionally, although an inner face 534 of reinforcing ring 532 is shown parallel to a central axis 536 of second portion 508, inner face 534 may alternatively be angled relative to central axis 536, or may be arced to correspond with the curve of inner surface 528.

Figure 7C:
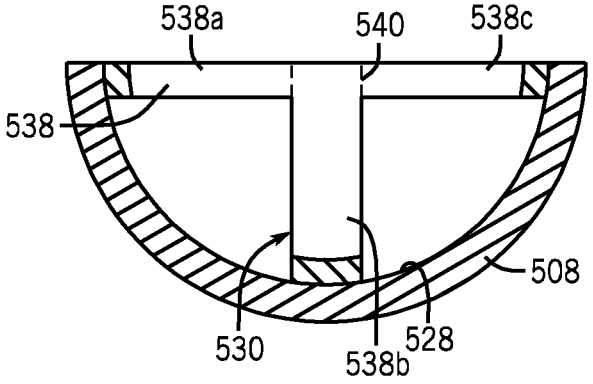

Referring to FIG. 7C, a side cross-sectional view of second portion 508 of outer shell 502 is shown having a second type of support structure 530 disposed therein. Ribs 538 are shown disposed on inner surface 528 of second portion 508. Ribs 538 may take any shape or size, and may extend along inner surface 528 in any desired direction. As shown, ribs 538*a*, 538*b*, and 538*c* intersect each other at junction 540; however, a plurality of ribs 538 may be positioned within second portion 508 such that no contact between ribs 538 occurs.

Figure 7D:
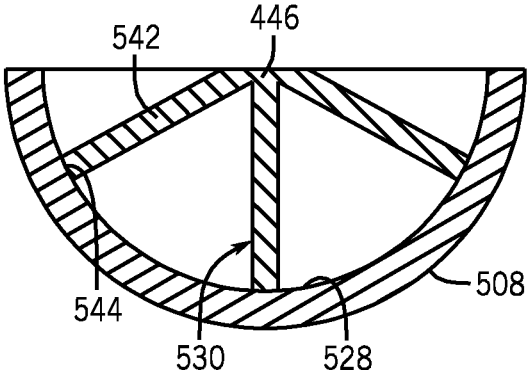

Referring to FIG. 7D, a side cross-sectional view of second portion 508 of outer shell 502 is shown having a third type of support structure 530 disposed therein. Specifically, spindles 542 may be used to help support outer shell 502, thereby maintaining the shape of outer shell 502 under high pressures, impact loads, and temperatures. In certain embodiments, a plurality of spindles 542 may extend radially outwardly from a center point 446 of an assembled activation ball 500, and may contact inner surface 528 of second portion 508 at an intersection 544. While specific examples of support structure configurations have been described, one of ordinary skill in the art will appreciate that other support structure configurations may be used without departing from the scope of embodiments disclosed herein.

Support structures 530 such as, for example, reinforcing rings 532, ribs 538, and spindles 542, shown in FIGS. 7B-7D, may be formed from a plastic, metal, ceramic, and/or composite material. Specifically, metal support structures may be formed from cast iron or low grade steel. In certain embodiments, support structures 530 may be formed integrally with first or second portions 506, 508 of outer shell 502. Alternatively, support structures 530 may be formed separately and may be assembled within outer shell 502 using welding, brazing, adhering, mechanical fastening, and/or interference fitting. Those of ordinary skill in the art will appreciate that materials, designs, and dimensions of support structures 530 may be selected to provide increased strength to outer shell 502 while maintaining an overall specific gravity of activation ball 500 between about 1.00 and about 1.85.

Figure 7E:
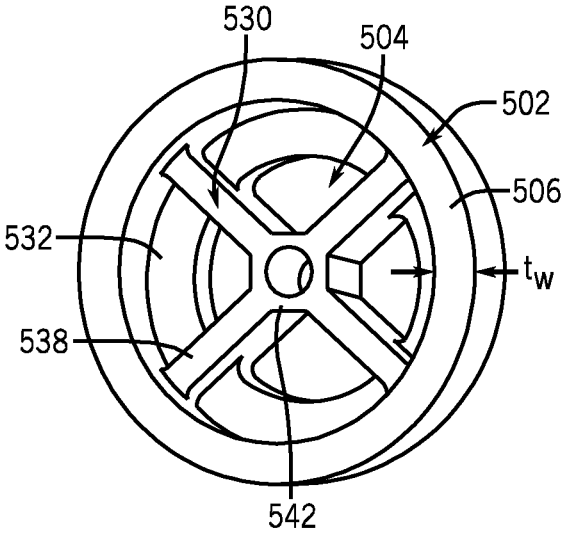
FIG. 7E is a perspective view of a portion of an activation ball in accordance with embodiments disclosed herein.

Referring to FIG. 7E, a perspective view of a first portion 506 of outer shell 502 of activation ball 500 is shown. Support structure 530 is shown disposed in hollow volume 504 of first portion 506. The support structure 530 is an assembly of reinforcing rings 532, ribs 538, and a spindle 542. Those of ordinary skill in the art will appreciate that various configurations of reinforcing rings 532, ribs 538, and spindles 542 may be used to create a support structure 530. Additionally, although not specifically shown, a support structure 530 as discussed above may be used in combination with a fill material injected into enclosed volume 504.

In certain embodiments, enclosed volume 504 may also be used to house equipment such as, for example, sensors. Sensors configured to measure pressure, temperature, and/or depth may be disposed within enclosed volume 504. Data collected by the sensors may be stored in a storage device enclosed within volume 504, or the data may be relayed to the surface of the wellbore.

Additionally, equipment such as, for example, receivers, transmitters, transceivers, and transponders, may be disposed within enclosed volume 504 and may send and/or receive signals to interact with downhole tools. For example, radio frequency identification (RFID) tags may be used as activation devices for triggering an electrical device in another downhole tool. For example, as the activation ball housing RFID tags passes through the wellbore, the RFID tags may activate a timer linked to the electrical device, which may lead to the performance of a desired task. In certain embodiments, a frac valve may be opened by initiating a corresponding timer using RFID tags and/or magnets housed within an activation ball. A magnet disposed within enclosed volume 504 may also be used to trigger and/or actuate downhole tools.

An activation ball in accordance with some embodiments may be manufactured by forming an outer shell out of a metallic material, wherein the outer shell includes an enclosed volume therein. In certain embodiments, the outer shell may be formed from a magnesium alloy, an aluminum alloy, a steel alloy, or nickel-cobalt base alloy. Specifically, an aluminum alloy may be selected from 6000 series aluminum alloys or 7000 series aluminum alloys, and a steel alloy may be selected from 4000 series steel alloys. In particular 4140 steel may be used. A nickel-cobalt base alloy such as, for example MP35N® may also be used. For ease of manufacturing, the outer shell may be made up of multiple portions joined together using, for example, welding, friction stir welding, brazing, adhering, threading, mechanical fastening, and/or pressure fitting. A wall thickness, tw, may vary depending on the material selected for outer shell 502, so that an overall specific gravity of activation ball 500 between about 1.00 and about 1.85 may be achieved. An activation ball formed from high strength materials such as MP35N® or 4140 steel may have an overall specific gravity of about 1.2. The low specific gravity of an activation ball formed from MP35N or 4140 steel may greatly increase the likelihood of recovering the activation ball using reversed fluid flow through the center bore in which the activation ball is seated.

In some embodiments, manufacturing the activation ball may further include filling the enclosed volume within the outer shell with a fill material such as, for example, plastic, thermoplastic, polyether ether ketone, fiber reinforced phenolic, foam, liquid, or gas. The outer shell enclosed volume may be filled such that a pressure inside of the outer shell is greater than atmospheric pressure, thereby providing the activation ball with increased strength against impact loads and high pressures.

Alternatively, a rigid support structure may be provided within the enclosed volume of the outer shell. As discussed above, reinforcing rings, ribs, and spindles may be used separately or in combination to form the support structure. The support structure may be formed integrally with the outer shell by machining, casting, or sintering the outer shell. In another embodiment, the support structure may be formed as a separate component and may be later installed within the outer shell. In embodiments having a support structure fabricated separately from the outer shell, the support structure may be installed using welding, brazing, adhering, mechanical fastening, and/or pressure fitting. The support structure may be designed such that, when assembled within the activation ball, pressure applied by the support structure to the inner surface of the outer shell is greater than atmospheric pressure.

Advantageously, embodiments disclosed herein provide for an activation ball having increased strength under impact loads, high pressures, and high temperatures, while having an overall specific gravity between about 1.00 and about 1.85. Activation balls in accordance with the present disclosure may also have greater durability than activation balls formed from composite materials which degrade over time. Further, activation balls having a metal shell as disclosed herein may be more reliable due to the consistency of mechanical properties between different batches of metallic materials. Because of the consistency of mechanical properties of metallic materials, and because of their high strength, activation balls in accordance with the present invention can be designed to have less contact area between the activation ball and a corresponding bearing area. As such, activation balls disclosed herein may allow for an increased number of ball activated downhole tools to be used on a single drill string. As a non-limiting example, by using an activation ball described in the embodiments above, approximately twelve fracturing valves (such as the sleeve valves 33) may be used during a multi-stage fracturing process, whereas approximately eight fracturing valves may be used with traditional activation balls.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention

What is claimed is:

1. An untethered object for deployment into a wellbore fluid passageway, the object comprising:

a spherical metallic body defining an enclosed volume and sized for landing in a seat for creating an obstruction within a wellbore fluid passageway, wherein the body is hollow to reduce its specific gravity to less than 2.0 for flowback of the object; and a sensor positioned within the volume.

2. The object of claim 1, wherein the sensor comprises a pressure sensor.

3. The object of claim 1, wherein the sensor comprises a temperature sensor.

4. The object of claim 1, wherein the sensor comprises a depth sensor.

5. The object of claim 1, further comprising:

a storage device disposed within the enclosed volume and configured to collect data from the sensor.

6. The object of claim 1, further comprising:

a radio frequency identification tag.

7. The object of claim 1, wherein the sensor is disposed within the enclosed volume.

8. The apparatus of claim 1, further comprising a fill material positioned within the body, wherein the fill material comprises at least one of a plastic, thermoplastic, poly ether keytone, fiber reinforced phenolic, foam, liquid, or gas.

9. The apparatus of claim 1, wherein the volume of the body comprises one or more support structures made of at least one of plastic, metal, ceramic, and composite material.

10. A system comprising:

a tubular string comprising a seat and a fluid passageway;

an untethered object configured to flow through the fluid passageway and lodge within the seat to create an obstruction within the fluid passageway, the object comprising a hollow spherical metallic body defining an enclosed volume, wherein the object comprises a specific gravity selected to be less than 2.0 to facilitate flowback of the object, wherein the system comprises a plurality of seats disposed along the tubular string.

11. The system of claim 10, wherein the tubular string is a casing string that extends from a surface location into a wellbore.

12. The system of claim 10, wherein the plurality of seats comprise inner diameters that become progressively smaller when moving toward an end of the wellbore.

13. The system of claim 12, wherein the system comprises a plurality of untethered objects with varying diameters.

14. The system of claim 10, further comprising a sensor within the body, wherein the sensor comprises at least one of a pressure sensor and a temperature sensor.

15. The system of claim 14, further comprising:

a storage device disposed within the enclosed volume and configured to collect data from the sensor.

16. The system of claim 10, wherein the metallic hollow body comprises one or more support structures inside made of at least one of plastic, metal, ceramic, and composite material.

17. A method comprising:

selecting a hollow metallic untethered object, the object having a specific gravity of less than 2.0;

deploying the untethered object within a tubular string comprising a fluid passageway to form an obstruction within the fluid passageway;

pressurizing a region of the tubular string using the obstruction;

measuring at least one of pressure and temperature using a sensor disposed within the object; and flowing back the untethered object.

18. The method of claim 17, wherein the tubular string is a casing string that extends from a surface location into a wellbore.

19. The method of claim 18, wherein the object is deployed by flowing the object through fluid in the fluid passageway.

20. The method of claim 19, wherein the object forms the obstruction by lodging within a seat disposed along the tubular string.

21. The method of claim 20, wherein the object is deployed by flowing the object through at least one other seat disposed along the tubular string.

22. The method of claim 17, further comprising:

activating a downhole tool using a radio frequency identification tag disposed within the object.

* * * * *